United States Patent [19]

Whitwell

[11] Patent Number: 5,034,248

[45] Date of Patent: Jul. 23, 1991

[54] BIS(AMINOALKOXY) AND BIS(ALKYLAMINOALKOXY)COPPER(II) SOLUTIONS, PREPARATION AND USE

[75] Inventor: George E. Whitwell, Campbell Hall, N.Y.

[73] Assignee: Akzo America Inc., New York, N.Y.

[21] Appl. No.: 270,569

[22] Filed: Nov. 14, 1988

[51] Int. Cl.[5] ..... B05D 5/12

[52] U.S. Cl. ..... 427/126.6; 427/62; 427/226; 556/116

[58] Field of Search ..... 427/226, 62, 126.6; 556/116

[56] References Cited

U.S. PATENT DOCUMENTS

| | | | |
|---|---|---|---|
| 2,446,682 | 8/1948 | Whitner | 8/604 |
| 4,129,434 | 12/1978 | Plumat et al. | 427/229 |
| 4,399,090 | 8/1983 | Sprangers et al. | 427/226 |

OTHER PUBLICATIONS

Chem. Abstr., vol. 74, 54219z (1971).
Chem. Abst. vol. 98, 48599c (1983).
Chem Abstr, vol. 95, 185811t (1981).
Brannon et al., in J. Inorg. Nucl. Chem., vol. 33, pp. 981-990 (1971).
Chem. Abstr., vol. 59, 8340h (1963).
Chem. Abstr., vol. 62, 12730f (1965).

*Primary Examiner*—Janyce Bell
*Attorney, Agent, or Firm*—Richard P. Fennelly; Louis A. Morris

[57] ABSTRACT

Copper oxide films can be formed on a substrate by coating the substrate with an organic solvent containing an aminoalkoxy copper(II) compound, and pyrolyzing the thus formed coating. The aminoalkoxy copper compound can be a bis(aminoalkoxy)copper(II) compound, a bis(alkylaminoalkoxy) copper(II) compound, or mixtures thereof.

4 Claims, 20 Drawing Sheets

United States Patent Office

PTO - BOYERS, PA Duty Station

MISSING PAGE TEMPORARY NOTICE

PATENT # 5034248 FOR ISSUE DATE 7-23-91

HAS BEEN SCANNED, BUT WITH MISSING PAGE(S). UPON RECEIVING OF MISSING PAGE(S), THE ENTIRE DOCUMENT WILL RE RESCANNED. PLEASE CALL IMAGE DATA ADMINISTRATION STAFF OF 557-6154 IF YOU HAVE A QUESTION. ASK FOR DAVE GROOMS, ANITA YOUNG OR POLA JONES.

THIS NOTICE IS FOR THE MISSING PAGE CONTAINING:

DRAWING SHEET # 1 thru 20

Data Conversion Operation

Boyers, Pa

BIS(AMINOALKOXY) AND BIS(ALKYLAMINOALKOXY)COPPER(II) SOLUTIONS, PREPARATION AND USE

BACKGROUND OF THE PRESENT INVENTION

1. Field of the Invention

The present invention relates to bis(aminoalkoxy) and bis(alkylaminoalkoxy)copper(II) solutions which are useful, for example, in supplying copper values for formation of thin films containing copper oxide.

2. Description of the Prior Art

Certain disclosures exist in the prior art in regard to the utility of complexes between copper and alkanolamines: U.S. Pat. No. 2,446,682 teaches the effectiveness of aqueous compositions comprising alkylolamine-copper complexes in the treatment of cellulose textiles and mentions primary, secondary and tertiary alkanolamines as possible reagents in the formation of such complexes; Chem. Abstr., Vol. 74, 54219z (1971) mentions the use of a copper(II)-monoethanolamine complex in the presence of carbon tetrachloride in the polymerization of vinyl monomers; Chem. Abstr., Vol. 98, 48599c (1983) discloses the use of copper ethanolamine as an algicide; and Chem. Abstr., Vol. 95, 185811 (1981) mentions the impact of the copper chelate of ethanolamine on calf growth under conditions of copper insufficiency.

Certain disclosures also exist in the prior art which do not disclose a utility for the copper/alkanolamine product. Brannon et al., in *J. Inorg. Nucl. Chem.*, Vol. 33, 981–990 (1971) discuss the infrared spectra of certain copper(II) complexes of mono-, di-, and triethanolamines. The reaction of copper oxide and hydroxide with monoethanolamine, diethanolamine, and triethanolamine is mentioned in Chem. Abstr., Vol. 59, 8340h (1963). Cupric chloride-monoethanolamine complexes are further discussed in Chem. Abstr., Vol. 62, 12730f (1965).

SUMMARY OF THE PRESENT INVENTION

The present invention relates to a process of preparing a film containing a copper oxide which involves coating a substrate with an organic solution comprising a bis(aminoalkoxy) and/or bis(alkylaminoalkoxy)copper(II) compound solubilized therein and pyrolyzing the coated substrate to form the copper oxide-containing film.

DETAILED DESCRIPTION OF THE PRESENT INVENTION

The bis(aminoalkoxy)copper(II) compounds of the present invention have the formula $Cu(ORNH_2)_2$, where R is alkylene of from 2 to about 4 carbon atoms in length. A preferred R group is ethylene. These compounds can be formed by the reaction of a cupric salt (e.g., a cupric halide such as cupric chloride) with an alkali metal alcoholate (e.g., sodium aminoethoxide, in alcohol solution. The latter compound can be prepared by reaction of an alkanol and an alkali metal. The bis(alkylaminoalkoxy)copper(II) compounds have the formula $Cu(ORNHR')_2$, where R is as defined above and R' can be an alkyl group of from 1 to 4 carbon atoms. These compounds can be formed by an analogous reaction wherein an N-alkylaminoalkanol is substituted for the unsubstituted aminoalkanol.

The aminoalkoxy copper(II) compounds intended for use herein are derived from primary and secondary amino alcohols and have at least one hydrogen substituent on the amino nitrogen atom.

The solution which forms contains the desired bis(aminoalkoxy) or bis(alkylaminoalkoxy)copper(II) compound and is soluble in organic solvents, such as alkoxyalkanols (e.g., methoxypropanol) for use as an organic solution, containing dissolved copper and oxygen values therein, which can be pyrolyzed to form a copper oxide film on a substrate. If desired, mixtures of the two types of aminoalkoxy copper compounds described above can be used.

The organic solvent containing the aminoalkoxy copper compound or compounds can be combined with other organic solvent compositions containing solubilized metal compounds (e.g., those of barium and yttrium, for example) to form copper oxide-containing superconductor compositions.

The Examples which follow illustrate certain embodiments of the present invention.

EXAMPLE 1

This Example illustrates formation of bis(aminoethoxy)copper(II) in accordance with the present invention.

All procedures were performed under an argon atmosphere. The ethanol was distilled from magnesium ethoxide. The ethanolamine was distilled from calcium hydride.

A solution of sodium ethoxide in ethanol was prepared from sodium (3.83 grams) and ethanol (200 ml). Titration with HCl gave concentration of 0.885M. Ethanolamine (9.05 ml; 150 mmol) was added to the solution (vol.=167 ml) to form an ethanol solution of sodium aminoethoxide (I). Anhydrous copper(II) chloride (4.0 grams; 30 mmol) was dissolved in ethanol (95 ml). Solution I (67 ml; 60 mmol) was added to the green Cu solution which turned violet-blue and produced a precipitate. The solution was filtered and the ethanol was removed in vacuo to yield a violet solid (~4.0 grams), bis(aminoethoxy)copper(II), which is soluble in methoxypropanol.

EXAMPLE 2

All procedures were performed under an argon atmosphere. Ethanol was distilled from magnesium ethoxide.

A solution of sodium ethoxide was prepared from sodium metal (about 1.3 gram; 57 mmol) and ethanol (100 ml). Three 10 ml aliquots were titrated with 1NHCl and were determined to be of 0.835M concentration. The remaining solution (67 ml; 56 mmol) was treated with N-methylaminoethanol (4.21 grams; 56 mmol) to produce 72 ml of a solution containing 16.6 mg/ml of sodium methylaminoethoxide.

Copper(II) chloride (2.69 grams; 20 mmol) was dissolved in ethanol (50 ml) to form a green solution. The sodium N-methylaminoethoxide solution (55.4 ml; 40 mmol) was added. The solution became violet and produced a light precipitate. A white precipitate (NaCl) was collected (2.16 grams; 92% theoretical). The violet solution (about 100 ml) contained about 3.6 grams of bis(methylaminoethoxy)copper(II).

EXAMPLE 3

A solution of copper bis(aminoethoxide) (0.2 grams) was prepared in methoxypropanol (3.8 grams; 5 wt %). The solution was coated onto a 2 inch diameter Si wafer with 1 gram of solution at 2500 rpm for 15 seconds in air. The dried film was heated to 420° C. for 15 minutes to form a clear reflective copper oxide film.

EXAMPLE 4

A solution was prepared containing yttrium isopropoxide (0.45 gram; 1.7 mmol), barium 1-methoxy-2propoxide (1.04 gram; 3.3 mmol) and copper 2-aminoethoxide (0.92 gram; 5.0 mmol) in 1-methoxy-2-propanol (22 ml). A solution of water in 1-methoxy-2-propanol (10 wt %; 4.2 ml) was added. This solution was used to coat 3 inch Si wafers which had previously been coated with $SrTiO_3$ (1500 Angstroms). The Y—Ba—Cu coatings were spincast in a $N_2$ filled drybox. The wafers were coated with 6 layers of YBCO with each layer precured at 250° C. for 10 minutes on a hot plate. The multicoated wafers were cured in a quartz tube in a furnace under $N_2/H_2O$ at 825° C. for 10 minutes with a 4 hour warmup and a 10 hour cool down under $O_2$. The total film thickness was 4400 Angstroms, for about 500 Angstroms per layer.

The Examples given above set forth certain embodiments of the instant invention and should not be construed in a limiting sense as defining the scope of protection which is desired. The claims which follow set forth the protection desired.

I claim:

1. A process for preparing a film comprising copper oxide on a substrate which comprises:

(a) coating the substrate with an organic solution comprising an aminoalkoxy copper(II) compound solubilized therein; and (b) pyrolyzing the thus coated substrate to form a copper oxide-containing film on the substrate.

2. A process as claimed in claim 1 wherein the copper compound is of the formula $Cu(ORNH_2)_2$, where R is $C_2$ to $C_4$ alkylene.

3. A process as claimed in claim 1 wherein the copper compound is of the formula $Cu(ORNHR')_2$ where R is $C_2$ to $C_4$ alkylene and R' is $C_1$ to $C_4$ alkyl.

4. A composition for preparing a film comprising copper oxide on a substrate which composition comprises an organic solvent and, at least partially dissolved therein, an aminoalkoxy copper(II) compound of the formula $Cu(ORNHR')_2$ where R is $C_2$ to $C_4$ alkylene and R' is $C_1$ to $C_4$ alkyl.

* * * * *